United States Patent [19]

Rao

[11] Patent Number: 4,499,473

[45] Date of Patent: Feb. 12, 1985

[54] CROSS POLARIZATION COMPENSATION TECHNIQUE FOR A MONOPULSE DOME ANTENNA

[75] Inventor: Basrur R. Rao, Lexington, Mass.

[73] Assignee: Sperry Corporation, New York, N.Y.

[21] Appl. No.: 363,357

[22] Filed: Mar. 29, 1982

[51] Int. Cl.[3] ..... H01Q 19/06; H01Q 23/00

[52] U.S. Cl. ..... 343/754; 343/756; 343/372; 343/16 M

[58] Field of Search ..... 343/361, 371, 372, 753, 343/754, 909, 911 R, 911 L, 368

[56] References Cited

U.S. PATENT DOCUMENTS

| | | | |
|---|---|---|---|
| 3,618,092 | 11/1971 | Waineo | 343/16 M |
| 3,656,165 | 4/1972 | Walter et al. | 343/754 |
| 3,755,815 | 8/1973 | Stangel et al. | 343/376 X |
| 3,805,268 | 4/1974 | Britt | 343/16 M X |
| 4,051,474 | 9/1977 | Mack et al. | 343/756 X |
| 4,283,795 | 8/1981 | Steinberger | 343/361 X |
| 4,348,678 | 9/1982 | Thomas | 343/368 X |

*Primary Examiner*—Theodore M. Blum
*Assistant Examiner*—Gilberto Barrón, Jr.
*Attorney, Agent, or Firm*—Howard P. Terry; Seymour Levine

[57] ABSTRACT

An improved dome antenna system wherein compensation for cross polarized signal components in a received difference pattern of the feed array of the system is accomplished with a second array cross polarized to the feed array. This second array is density tapered to establish an aperture distribution function that is substantially equal to the aperture distribution function of the feed array. Weighting factors, programmed as a function of the boresight scan angle, are applied to the output signals of this second array and the weighted signals are subtracted from the difference signals of the feed array.

4 Claims, 12 Drawing Figures

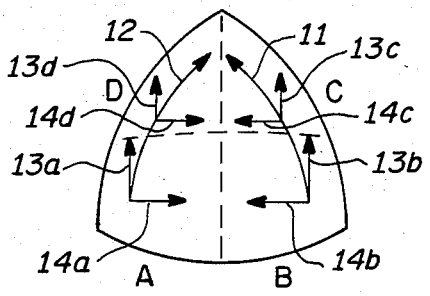
FIG.1a.
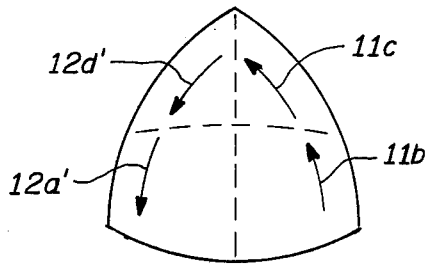
FIG.1h.
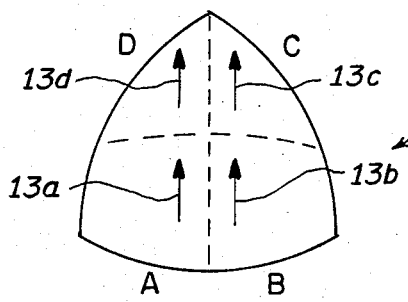
SUM=A+B
+C+D
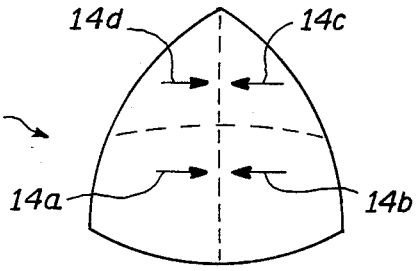
FIG.1b.
FIG.1c.
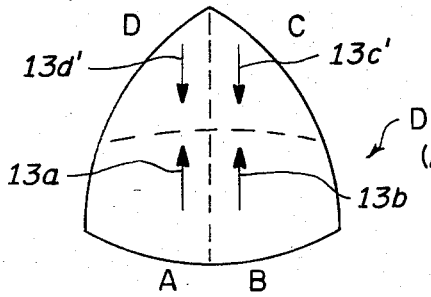
DIFFERENCE=
(A+B)−(C+D)
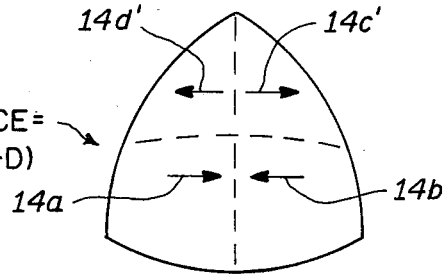
FIG.1d.
FIG.1e.
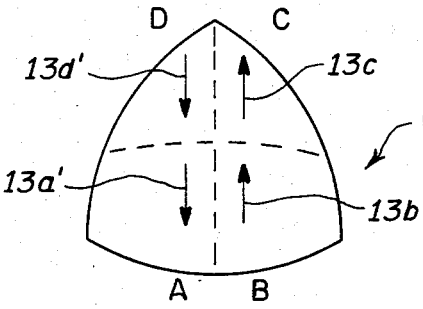
DIFFERENCE=
(B+C)−(A+D)
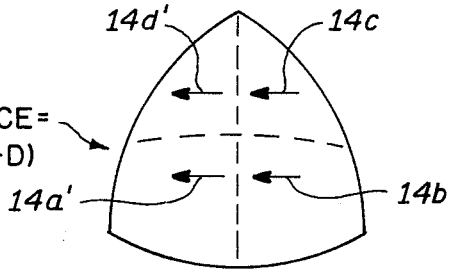
FIG.1f.
FIG.1g.

CROSS POLARIZATION COMPENSATION TECHNIQUE FOR A MONOPULSE DOME ANTENNA

BACKGROUND OF THE INVENTION

1. Field of the Invention

The subject invention pertains to the art of antennas and specifically to a cross polarization compensated feed array for a dome lens antenna.

2. Description of the Prior Art

Dome antenna systems such as that disclosed in U.S. Pat. No. 3,755,815, issued Aug. 28, 1973 to Stangel et al. and assigned to the assignee of the present invention achieve hemispherical scan coverage with a single active planar phased-array feeding a dome shaped lens. This novel antenna design offers a number of significant advantages over conventional multifaced planar arrays including: substantially reduced cost; reduced complexity; and increased scan coverage, having greater than hemispheric scan capabilities. The dome antenna, however, exhibits undesirable cross polarization characteristics created by the depolarizing effects of the conformal surface of the dome shaped lens. This problem is exacerbated by the variation of the refractive index of the dome as a function of elevation angle. Additionally, the distributive source characteristics of the feed system of the lens provides an illumination which varies with scan angle. These factors contribute to the polarization distortion realized by a dome antenna system. When the feed array is designed for monopulse operation, the cross-polarized components in the far-field radiation pattern, generated by this polarization distortion, fill the central null in the monopulse difference pattern, thereby degrading the angular tracking accuracy of the radar system. To provide monopulse radar high precision tracking, with the dome antenna system, it is necessary to substantially eliminate the null filling caused by the cross-polarization components.

One proposed solution to the problem introduces independent polarization control in each element of the feed array. For dome antenna systems, the cost of implementing such a scheme would be prohibitive, requiring two phase shifters (one for each polarization) and a preprogrammed attenuator for each element in the array, which may number over a thousand. Another proposal introduces appropriate amplitude weighting to the elements for each scan angle to reduce the cross-polarization level in the antenna difference pattern. This method is also complex and expensive.

SUMMARY OF THE INVENTION

A dome antenna with mono-pulse difference signal cross-polarization compensation in accordance with the principles of the present invention, includes a receiving array of antenna elements positioned in an orthogonally polarized relationship with the elements in the feed array of the dome antenna. Output signals from the receiving array are combined with the output signals from the difference. channels of the feed array in a manner to cancel cross polarization components in the mono-pulse difference signal caused by the depolarizing effects of the dome lens and the target. The elements in the receiving array may be interspersed with the elements of the feed array and may be density tapered in accordance with the amplitude distribution of the feed array.

BRIEF DESCRIPTION OF THE DRAWINGS

FIGS. 1*a* through 1*h* are illustrations of the principal and cross polarization components of a monopulse dome antenna system on the surface of the dome shaped lens.

DESCRIPTION OF THE PREFERRED EMBODIMENT

Figure 2:
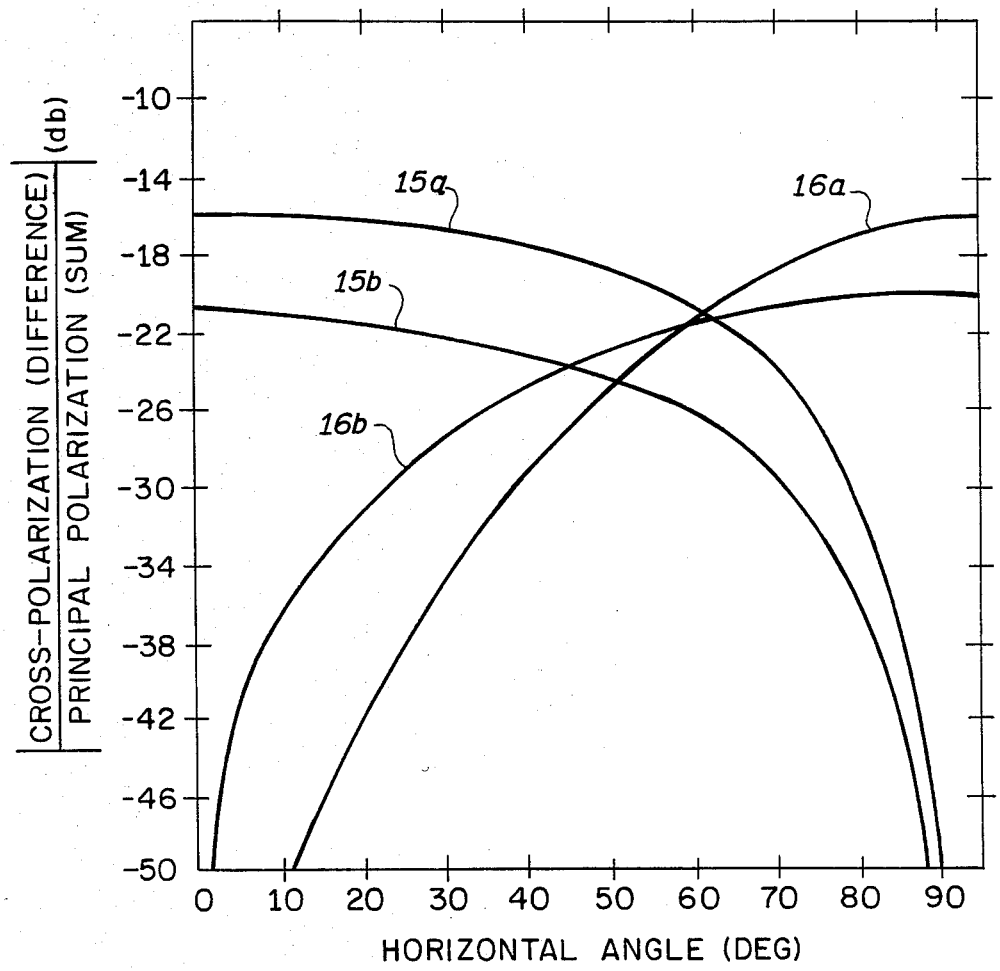
FIG. 2 is a graph of a cross-polarization component level generated by the dome lens at various bore sight angles.

A conventional phase comparison monopulse antenna comprises a planar array divided into four substantially equal sub-arrays that are combined through a feed system to generate a sum beam and two orthogonal difference beams. All the antenna elements in the array are oriented in the same direction. Consequently, the far field signal polarization from each quadrant, and concomitantly the signal polarization in the monopulse beams, is that of an antenna element in the beam pointing direction. A monopulse dome antenna, however, possesses a non-planar secondary radiating surface, such as a sphere, an ellipsoid, a capped cone, or a cylinder, that is illuminated by a monopulse planar array. Identical passive elements that are positioned on the nonplanar surface necessarily have different orientations with respect to the beam pointing direction. This orientation difference causes the far field signal polarization of the monopulse beams to differ from that of the dome element signal polarization, and the feed array signal polarization. Since each quadrant of the feed array illuminates a different region of the dome, the signal polarization for each quadrant in the far field is different. This polarization difference causes the bore signt null of the monopulse antenna difference pattern to fill.

FIGS. 1*a* through 1*h* represent polarization projections on the dome surface of a linearly polarized, circular feed array scanned in the horizontal and vertical planes to 90°. A linearly polarized field on a feed array appears curved when projected on the surface of the dome as represented by the polarization vectors 11, 12 in FIG. 1*a*. If the monopulse feed array is circular the projection of the array on the surface of the dome is triangular as are the four quadrants of the array, labeled A, B, C, and D in FIG. 1*a*. The polarization vectors 11, 12 may be resolved into two orthogonal components in each quadrant, a principal component 13*a* through 13*d* and a cross-polarization component 14*a* through 14*d*. It should be noted that the cross polarized components are in phase opposition in the horizontally adjacent quadrants.

A monopulse sum pattern is obtained by adding the contributions from the quadrants A,B,C, and D. As shown in FIG. 1*b* the principal polarized components 13*a*, 13*b*, 13*c*, and 13*d* add in phase, giving rise to a maximum in the boresight direction, while, as shown in FIG. 1*c* the cross polarized components 14*a* and 14*d* are in phase opposition to the cross polarized components 14*b* and 14*c* giving rise to a null in the boresight direction. A vertical difference pattern is formed by taking the difference (A+B)−(C+D). As shown in FIG. 1*d*, the polarization components 13*c'* and 13*d'* are in phase opposition with the polarization components 13*a* and 13*b*, while as shown in FIG. 1*e*, the cross polarized components 14*a* and 14*c'* are in phase opposition with 14*b* and 14*d'*, hence the difference pattern for both the principal and cross polarization components exhibit a null in the boresight direction. A Horizontal difference pattern is formed by taking the difference (B+C)−(A+D). As shown in FIG. 1*f*, the principal polarization components 13*a'* and 13*d'* are a phase opposition to the principal polarization components 13*b* and 13*c*, thus establishing a null in the boresight direction; while the cross polarization components 14*a'*, 14*b*, 14*c*, and 14*d'* are in phase and form a maximum in the boresight direction. It is this maximum in the antenna horizontal difference pattern that causes the monopulse tracking errors. If the tracked target is non-depolarizing the polarization of the signal back scattered by the target is the same as the incident polarization, and the received resultant polarization 12*a'* is substantially collinear with the received resultant polarization 12*d'* as are the resultant polarizations 11*b* and 11*c*, as shown in FIG. 1*h*. The polarizations 12*a'* and 12*d'*, however, are in phase opposition with the polarizations 11*b* and 11*c*, thus little null filling results. Generally, however, the scattered signals from a radar target exhibit polarizations that differ from the polarization of the incident signal. This depolarization of the echo signal, coupled with the polarization distortion created by the dome, reorients the received resultant polarizations and causes the tracking null to shift from the design boresight direction.

The magnitude of the cross polarized difference signals in the orthogonal planes are functions of the horizontal and vertical angles at boresight. In FIG. 2 are shown representative cross polarization levels, normalized to the peak of the sum beam, as a function of horizontal angle for two representative vertical angles. The curves 15*a* and 15*b* are for the vertical difference pattern, while the curves 16*a*, 16*b* are for the horizontal difference pattern. It should be noted that the cross polarization levels for the two difference patterns, that are introduced by the geometry of the dome, vary as different functions of horizontal and vertical angle, thus requiring separate compensation.

The monopulse tracking signal e (0) near boresight in one tracking plane, as for example the horizontal plane, for a dome antenna system may be represented by;

$$e(0) = Re\left[j\left\{\frac{\Delta_{11}}{\Sigma_{11}} + \frac{T_{12}}{T_{11}}\ \frac{\Delta_{12}}{\Sigma_{11}}\right\}\right] \quad (1)$$

Where:

$\Delta_{11}$ is the difference channel signal near boresight due to components of the received signal that are polarized substantially as the transmitted signal.

$\Delta_{12}$ is the difference channel signal near boresight due to components of the received signal that are substantially cross polarized with respect to the transmitted signal, $\Sigma_{11}$ is the sum channel signal near boresight due to the components of the received signal that are polarized substantially as the transmitted signal.

$T_{12}$ is the target backscatter cross polarization coefficient.

$T_{11}$ is the target backscatter principal polarization coefficient.

It is readily determined from equation (1) that the elimination of the term $$\frac{T_{12}}{T_{11}}\ \frac{\Delta_{12}}{\Sigma_{11}}$$

provide an error free tracking signal. This desirable situation exists when either $T_{12}=0$ or $\Delta_{12}=0$. Since $\Delta_{12}$ is a characteristic of the dome, and therefore determinable, a compensation technique based on the elimination of this term is required. This may be accomplished by incorporating a compensating receiving antenna, scannable with the planar feed array of the dome antenna system, and having elements interspersed among, and crossed polarized to, the elements of the feed array. Since the cross polarization component of the difference signal varies with scan angle, the output signal of the receiving array, which is peaked at the boresight angle, may be weighted in accordance with the angular position of the boresight line.

Figure 3:
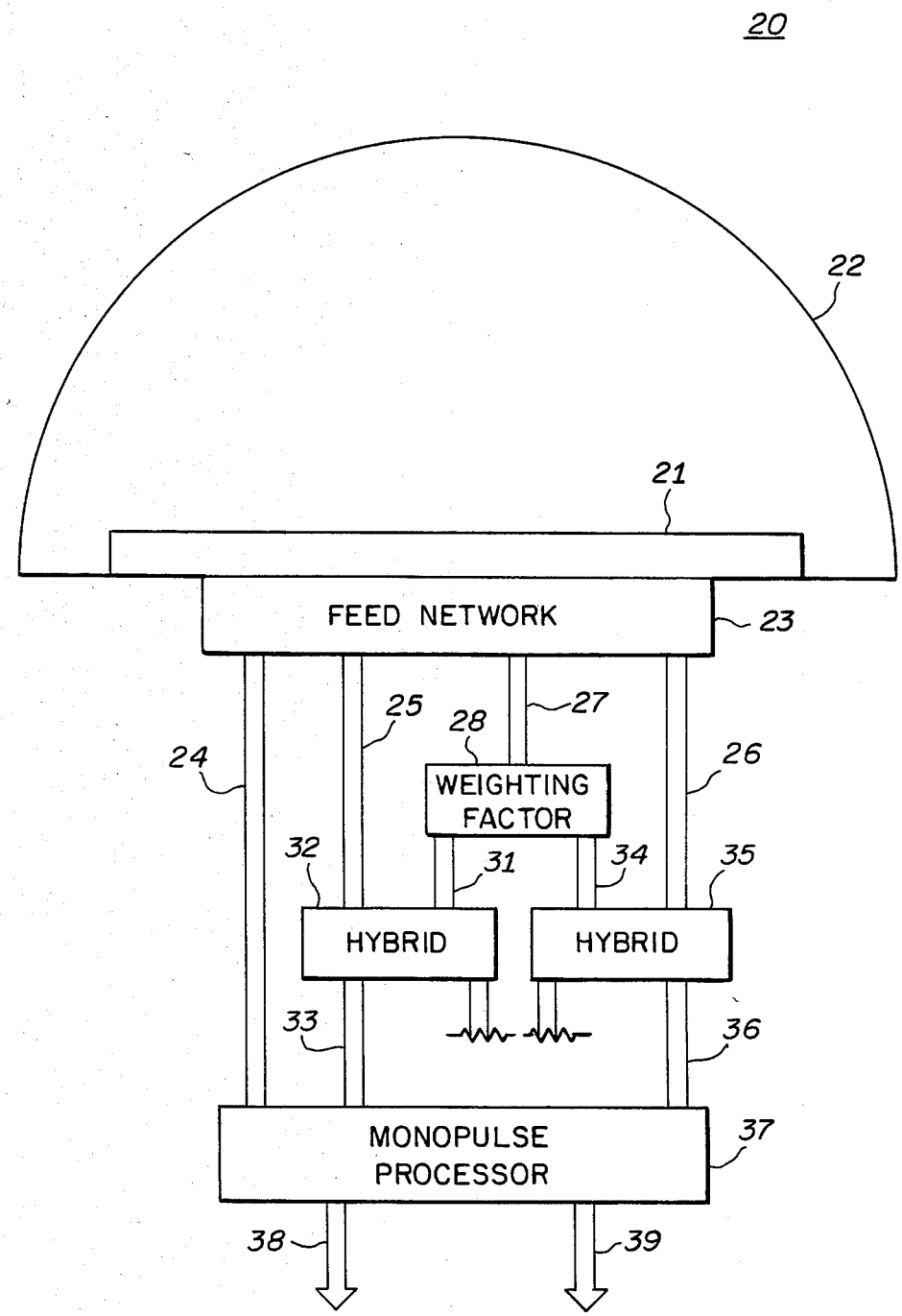
FIG. 3 is a schematic diagram of a dome lens antenna with cross polarization compensation circuitry.

Refer now to FIG. 3 wherein a schematic of the receiving circuitry for a monopulse dome antenna system 20 is shown. An aperture 21 which includes the elements of the feed array and the elements of the receiving array dispersed therebetween, is positioned within the dome lens 22. A feed network 23 couples the elements of the feed array to the monopulse sum signal channel 24, to the horizontal difference signal channel 25 and to the vertical difference signal channel 26. Feed network 23 also couples the elements of the receiving array to an output channel 27, which in turn is coupled to a weighting factor generator 28. The receiving array is scanned with the feed array such that the peak of the receiving array pattern lies along the boresight line of the feed array. The output signal from the receiving array is coupled to the weighting factor generator 28, wherein the signal from the receiving array is split into two signals to which complex weighting in accordance with the compensation required for the horizontal and vertical difference signals as the function of the scan angle, are applied.

The horizontal compensating signal from the weighting factor generator 28 may be coupled, via the output channel 31, to a hybrid circuit 32, to which the horizontal difference channel is also coupled. Hybrid circuit 32 possesses an output channel 33 in which a signal representative of the difference between the signals coupled to the circuit from the horizontal compensating channel 31 and the horizontal difference channel 25 appears. Similarly, the vertical compensations signal from the weighting factor generator 28 may be coupled, via vertical compensation channel 34, to a second hybrid circuit 35, to which the vertical difference channel 26 is also coupled. Hybrid circuit 35 provides a signal at an output channel 36 that is representative of the difference between the vertical difference signal from channel 26 and the vertical compensation signal from compensation channel 34. Sum signal channel 24 and the output channels 33, 36 of the hybrid circuit 32, 35 are coupled to a monopulse processor 37, wherein, the sum channel signal, compensated horizontal difference signal, and the vertical compensated difference signal are processed to provide horizontal and vertical tracking signals that are coupled to the output channels 38 and 39 respectively.

The compensated difference signals in the horizontal compensation channel 33 and the vertical compensation channel 36 will be of the form:

$$\Delta_c = (\Delta_{11} - WA_{21})T_{11}\Sigma_{11} + (\Delta_{12} - WA_{22})T_{12}\Sigma_{11} \quad (2)$$

where $A_{21}$ is the response of the receiving antenna at boresight to signals polarized at the polarization of the feed array, $A_{22}$ is the response of the receiving antenna at boresight to signals polarized at a polarization orthogonal to the polarization of the receiving array and W is the weighting factor. It should be remembered that the receiving antenna is polarized orthogonally to the polarization of the feed antenna. By setting the weighting factor W to $$W = \frac{\Delta_{12}}{A_{22}}$$

the compensated error signal becomes:

$$e_c(0) = Re\left[j\left(\frac{\Delta_{11}}{\Sigma_{11}} - \frac{\Delta_{12}A_{21}}{\Sigma_{11}A_{22}}\right)\right] \quad (3)$$

the term $$\frac{\Delta_{12}}{\Sigma_{11}} \quad \frac{A_{21}}{A_{22}}$$

in equation (3) is small and may generally be neglected. This term, however, is a known function of scan angle and, for tracking accuracy requirements for which it becomes a limiting factor, a calibration factor for its elimination may be introduced into the system. The weighting factor W is in general complex and may be generated in the weighting factor generator 28 by a system of adjustable attenuators and phase shifters that are set to predetermined values for each scan angle.

To provide sufficient dynamic range for the weighting factor W, the gain of the receiving array should be in the order of 10 dB below the gain of the feed array sum channel. This may be accomplished with the receiving array having 10% of the number of elements and substantially the same aperture distribution of the feed array. Design parameters for the receiving array may be obtained by dividing the feed array into a multiplicity of annular rings, the width of each being substantially equal to the element spacing in the feed array. The illumination function over each annular ring and over the total feed array aperture is integrated and the ratio of the integral over the ring to the integral over the feed array aperture is taken. The receiving array elements are then dispersed within the annular rings in accordance with this ratio, the number of elements in a ring to the total number of elements in the receiving antenna (10% of the total number of elements in the feed array) is equal to the ratio of integrals for that ring; the receiver array elements being substantially uniformly dispersed about the rings.

Figure 4:
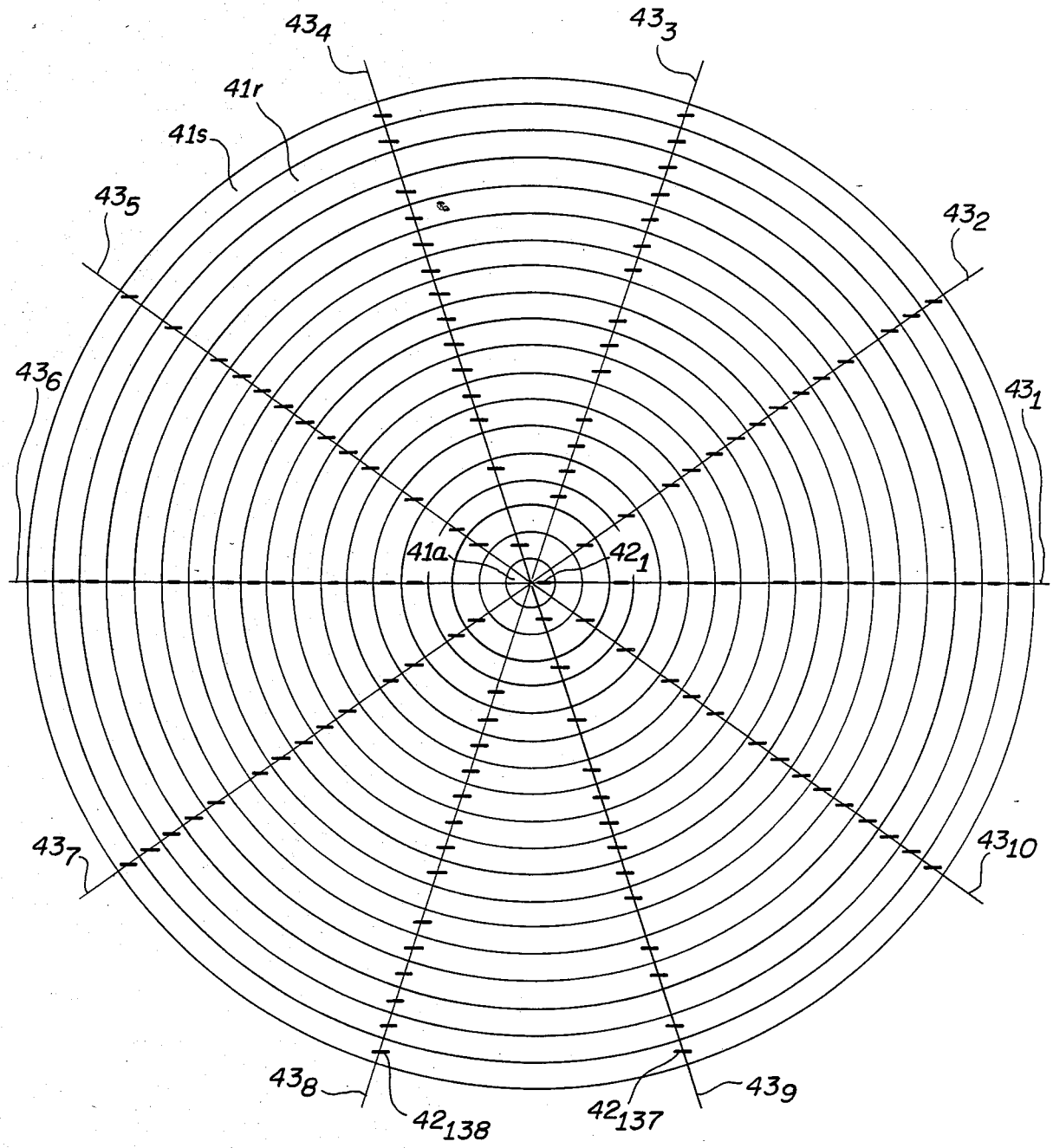
FIG. 4 is a diagram representative of the receiving antenna element distribution.

FIG. 4 is an illustration of a receiving array designed to compensate a feed array having a Taylor illumination function for a 30 dB side lobe level, 1381 elements, a radius of 3.5 inches, and interelement spacings of 1.237 inches. The feed array is divided into annular rings $\mathbf{41}_a$ through $\mathbf{41}_s$ totaling 19 with the width of each ring being 1.237 inches. The 138 elements of the receiving array are then distributed over the 19 rings as indicated in Table I. A multiplicity of equally spaced radials are drawn from the center of the feed array aperture, the number of radials being equal to the maximum number of elements within a ring, for the distribution of Table I ten radials are drawn. The receiving array elements are then distributed about each ring as uniformly as possible by positioning each element $\mathbf{42}_1$ through $\mathbf{42}_{138}$ on one of the ten radials $\mathbf{43}_1$ through $\mathbf{43}_{10}$.

TABLE I

| Number of Ring | Normalized Outer Radius of Ring | Radius in Inches | Taylor Weight | Number of Elements in Annular Ring |
|---|---|---|---|---|
| 1 | 0.053 | 1.237 | 1.0 | 1 |
| 2 | 0.105 | 2.473 | 0.99 | 2 |
| 3 | 0.157 | 3.710 | 0.995 | 4 |
| 4 | 0.210 | 4.947 | 0.982 | 5 |
| 5 | 0.263 | 6.184 | 0.955 | 6 |
| 6 | 0.315 | 7.421 | 0.915 | 7 |
| 7 | 0.368 | 8.675 | 0.867 | 8 |
| 8 | 0.421 | 9.894 | 0.818 | 8 |
| 9 | 0.473 | 11.131 | 0.770 | 9 |
| 10 | 0.526 | 12.368 | 0.721 | 9 |
| 11 | 0.578 | 13.604 | 0.664 | 10 |
| 12 | 0.631 | 14.841 | 0.597 | 9 |
| 13 | 0.684 | 16.078 | 0.522 | 9 |
| 14 | 0.736 | 17.315 | 0.446 | 8 |
| 15 | 0.789 | 18.552 | 0.384 | 8 |
| 16 | 0.842 | 19.788 | 0.349 | 8 |
| 17 | 0.894 | 21.025 | 0.345 | 8 |
| 18 | 0.947 | 22.262 | 0.360 | 9 |
| 19 | 1.0 | 23.50 | 0.374 | 10 |

Figure 5:
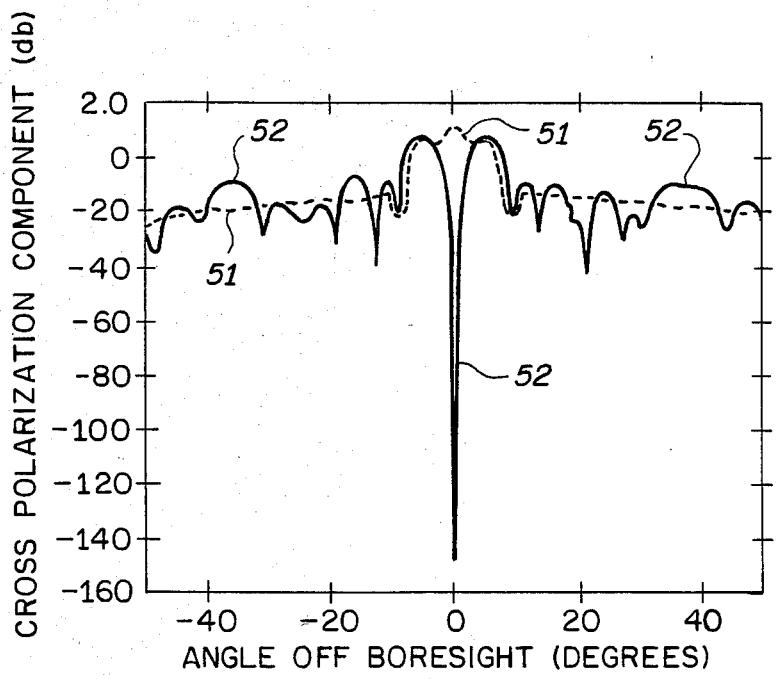
FIG. 5 presents plots of difference pattern cross polarization levels with and without polarization compensation.

FIG. 5 illustrates the cross polarization improvement realized near boresight for the 30 dB Taylor monopulse difference pattern with the utilization of the above described receiving array. Curve 51 represents the cross polarization level before compensation by subtracting the output signal of the receiving array from the output signal from the feed array, while curve 52 represents the cross polarization after such compensation. It is evident from the figure that the cross polarization at boresight has been reduced by over 140 dB and that significant improvements in the boresight region have been accomplished without substantially increasing the polarization levels in other regions of the difference pattern.

While the invention has been described in its preferred embodiments, it is to be understood that the words that have been used are words of description rather than of limitation and that changes within the purview of the appended claims may be made without departing from the true scope and spirit of the invention in its broader aspects.

I claim:

1. In an antenna of the type including a non-planar lens positioned in the field of a planar scannable antenna for modifying the scanning properties thereof, the planar scannable antenna having a plurality of elements, a planar array aperture, a planar array aperture distribution function, and at least one monopulse difference signal output port, the improvement comprising:

a receiving array, having a receiving array aperture and an output port, positioned in cross polarized relationship with said planar scannable antenna; and means coupled to said receiving array output port and to at least one of said difference signal output ports for combining signals at said difference signal output ports with signals at said receiving array output port in a predetermined manner to reduce null filling in said difference signal output ports due to polarization distortion caused by said non-planar lens.

2. An antenna in accordance with claim 1 wherein said coupling means includes:

means for applying complex weighting factors to signals at said receiving array output ports; and at least one network having first and second input ports coupled to receive signals from said weighting factor means and one of said difference signal output ports for providing signals at an output port which are differences between said signals from said weighting factor means and said signals from said one difference signal output port.

3. An antenna in accordance with claim 2 wherein said receiving array is space tapered to establish a desired receiving array aperture distribution.

4. An antenna in accordance with claim 3 wherein said space tapering is accomplished by a method that includes the steps of:

integrating said planar array aperture distribution function over said planar array aperture;

dividing said planar array aperture into annular rings each ring having a width that is substantially equal to spacings between elements in said planar array, elements of said planar array within each annular ring establishing an annular distribution function therewithin;

integrating said annular distribution function for each ring;

taking ratios of said integration of said annular distribution function to said integration of said planar array aperture distribution function;

establishing the total number of elements for said receiving array by taking a preselected percentage of said plurality of elements in said planar array;

positioning elements of said receiving array in each of said annular rings in numbers that are determined by multiplying said ratio for an annular ring under consideration by said total number of the elements in said receiving array.

* * * * *